United States Patent [19]

Ichihara et al.

[11] Patent Number: 4,825,344

[45] Date of Patent: Apr. 25, 1989

[54] HEADLAMP FOR VEHICLES

[75] Inventors: Takeo Ichihara, Hatano; Takashi Futami, Tokyo; Nobutaka Oda, Yokohama; Shuichi Watanabe, Yamato, all of Japan

[73] Assignee: Stanley Electric Co., Ltd., Tokyo, Japan

[21] Appl. No.: 78,876

[22] Filed: Jul. 28, 1987

Related U.S. Application Data

[63] Continuation-in-part of Ser. No. 14,396, Feb. 13, 1987, abandoned.

[30] Foreign Application Priority Data

Feb. 20, 1986 [JP] Japan ..... 61-23584[U]
Feb. 21, 1987 [JP] Japan ..... 62-24658[U]

[51] Int. Cl.[4] ..... F21V 7/09

[52] U.S. Cl. ..... 362/80; 362/83; 362/297; 362/346

[58] Field of Search ..... 362/297, 80, 83, 346

[56] References Cited

U.S. PATENT DOCUMENTS 4,506,315 3/1985 Maekawa et al. ..... 362/80
4,566,056 1/1986 Kouchi et al. ..... 362/297

FOREIGN PATENT DOCUMENTS 111579 6/1984 European Pat. Off. ..... 362/297

*Primary Examiner*—Albert W. Davis, Jr.
*Attorney, Agent, or Firm*—Frishauf, Holtz, Goodman & Woodward

[57] ABSTRACT

A headlamp for vehicles has a lens and a parabolic reflector which are made of synthetic resin and which are joined together by heat. A composite, light scattering reflector for scattering or spreading the light to be concentrated to the upper and central portion of the lens to an extend that no glare is generated, is arranged at the upper and central portion of the parabolic reflector. The composite reflector may be integrally formed with the main parabolic reflector, or may be a separate element joined to the main parabolic reflector.

13 Claims, 5 Drawing Sheets

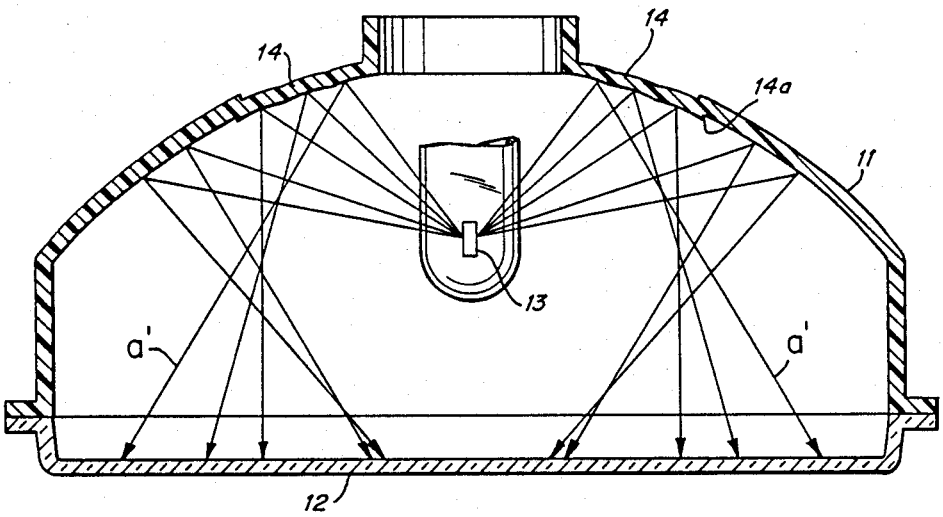
Fig. 6
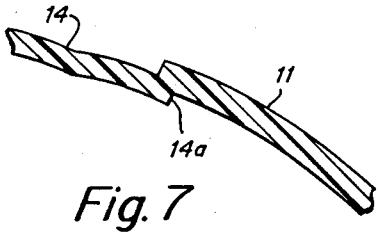
Fig. 7
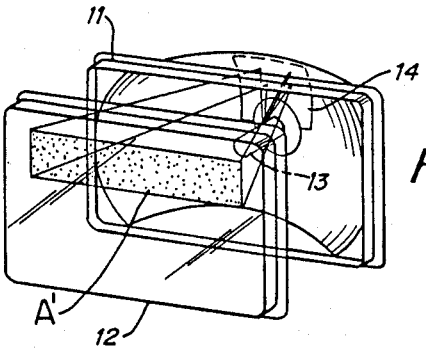
Fig. 8
Fig. 9
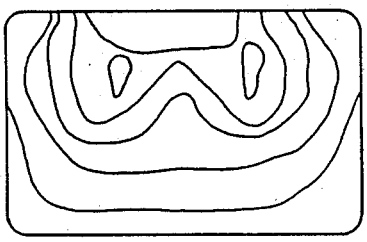

HEADLAMP FOR VEHICLES

CROSS REFERENCE TO RELATED APPLICATION

This is a continuation-in-part of prior application Ser. No. 014,396, filed Feb. 13, 1987 now abandoned.

BACKGROUND OF THE INVENTION

1. Field of the Invention

The present invention relates to a headlamp for use with vehicles such as automobiles, motorcycles and motorized bicycles.

2. Description of the Prior Art

In general, the construction as shown in FIGS. 1 and 2 is known as a headlamp for vehicles. The known headlamp has a reflector 1 having a parabolic surface and a lens 2 made of glass at the front of the reflector. A light source 3 is positioned in the vicinity of the focal point of the reflector 1 to direct the light emitted from the light source 3 to the lens 2 through reflection by the reflector 1.

In the conventional headlamp thus constructed, if the light source 3 used for, for example as the high beam or passing light, is energized, the reflected light a (see FIG. 1) from the reflector 1 is concentrated at one portion on the lens 2 as shown by the region A in FIG. 2, thereby resulting in the region A of the lens 2 being at a most high temperature. This condition is shown in FIG. 2, showing the reflected light being highly concentrated at the upper portion of the reflector 1 and lens 2. As shown by the temperature distribution curve in FIG. 3, the portion A of the upper and central portion of the lens 2 reaches a high temperature such as 142° C. Therefore, there has been the problem that a plastic lens having a good molding performance and light weight can not be adopted for the lens 2 of the headlamp, since such plastic materials would not properly withstand such high concentrated heat.

SUMMARY OF THE INVENTION

According to the present invention, a headlamp for vehicles comprises a source of light; and a lens and a parabolic reflector which are made of synthetic resin. The headlamp further comprises a composite reflector for scattering the light so that the light is concentrated to the upper and central portion of the lens to such an extent that no glare is generated. In one embodiment, the composite reflector is located at the upper and central portion of the parabolic reflector, thereby scattering the light to be concentrated to reduce the temperature of the lens surface. In another embodiment of the present invention, the composite reflector is formed as an independent body which is mounted at the upper and central portion of said parabolic reflector.

BRIEF DESCRIPTION OF THE DRAWINGS

FIG. 6 is an enlarged sectional view taken along the line III—III in FIG. 4;

FIG. 7 is a fragmentary enlarged view showing a portion of the reflector of FIG. 6 with the offset 14*a;*

FIG. 8 is a perspective view for explaining a state of the reflected light, due to a multi or composite reflector of the present invention, directed to the lens of the headlamp; lamp;

FIG. 9 is a graph showing the heat distribution on the lens surface, due to the composite reflector, in the headlamp of FIGS. 4–8;

DETAILED DESCRIPTION

Figure 4:
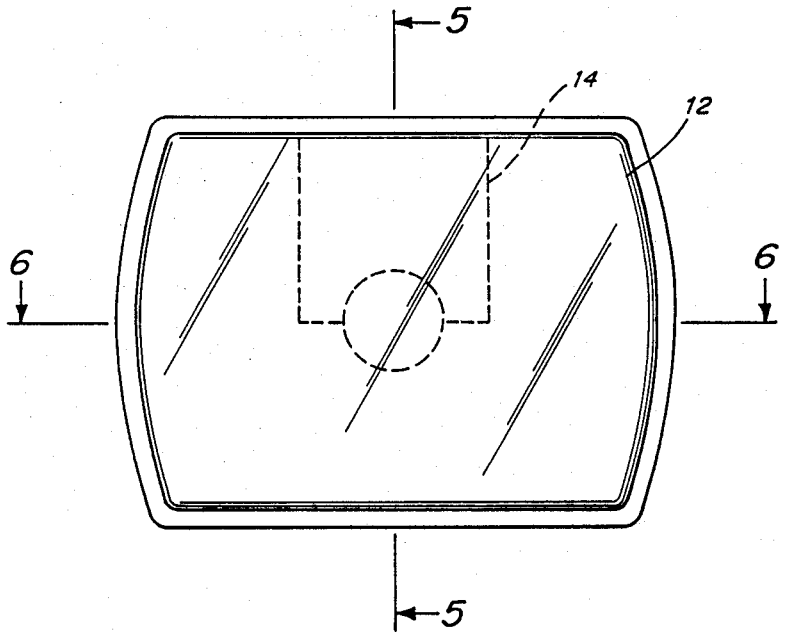
FIG. 4 is a schematic front view of the headlamp of the present invention.
Figure 5:
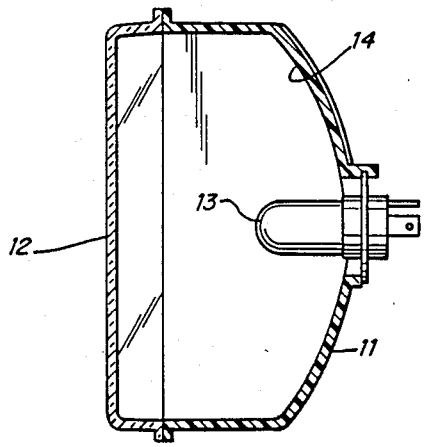
FIG. 5 is a sectional view taken along the line 5—5 in FIG. 4.

Referring now to FIGS. 4–9 of the drawings, a first embodiment of the present invention will be explained hereinafter in detail. As shown in FIGS. 4–6, a lens 12 is disposed at the front of a main parabolic reflector 11, and a bulb 13, preferably of the halogen-type, is disposed at approximately the center portion of the parabolic reflector 11 as a light source. The parabolic reflector 11 and lens 12 are molded from a synthetic resin having a good molding performance and light weight. A multi or composite reflecting surface 14 is formed at approximately the central and upper portion of the parabolic reflector. The synthetic resin from which the reflector 11 and the lens 12 are made is a material which is mutually adherable by heat, such as polycarbonate, acryl resin and ABS resin, so that the reflector 11 and lens 12 can be mutually joined together by heat.

Figure 12:
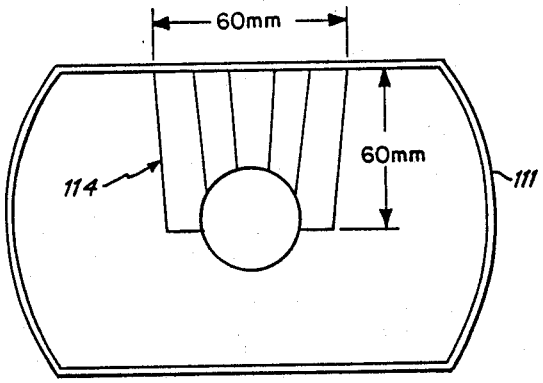
FIG. 12 is a front view of reflector 111 showing the segmentation, positioning, and dimensions of reflecting surface 114.
Figure 13:
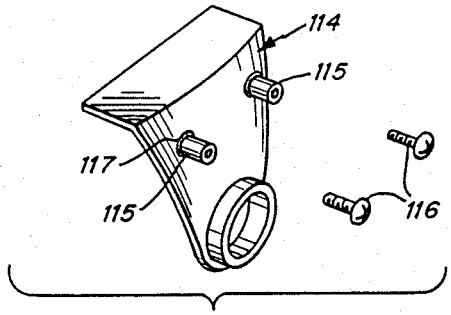
FIG. 13 is an exploded perspective view of reflecting surface 114 shown in FIG. 10.

As best seen in FIGS. 6, 7 and 12, the multi or composite reflecting surface 14 has a width of at least 60 mm in the horizontal direction and may be formed in the parabolic column surface, the revolutional paraboloid or a combination thereof having a focal length of F-15 to 40 mm. In brief, the incident light from the light source is divided into 1 to 10 parts in angular deviation so as not to concentrate the reflected light a (i.e., so as to spread the reflected light a). As shown in FIG. 7, the multi or composite reflecting surface 14 has an offset or step 14*a* at the boundary portion where surface 14 meets the single or smooth parabolic surface which comprises the greater part of the reflector 11. However, the offset or step 14*a* may be zero (that is, surface 14 can meet the remainder of reflector 11 without a step or offset 14*a* being present). The revolutional paraboloid comprising the composite reflecting surface 14 is defined as a surface formed in the curve of a circle or ellipse when a great many of vertical parabolas are viewed in the lateral direction.

Figure 1:
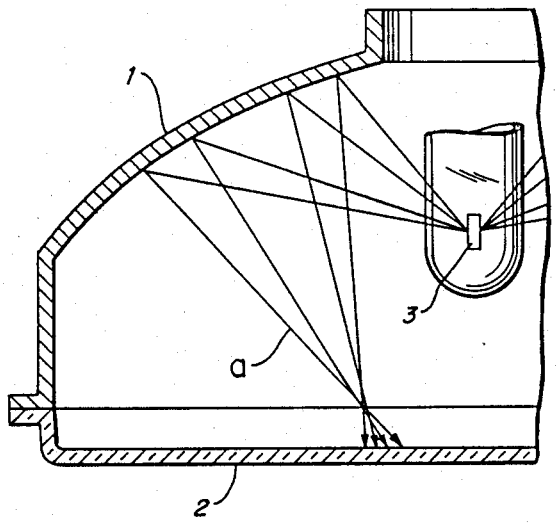
Fig. 1 (PRIOR ART)
FIG. 1 is a partially sectional view showing an example of a conventional headlamp.
Figure 2:
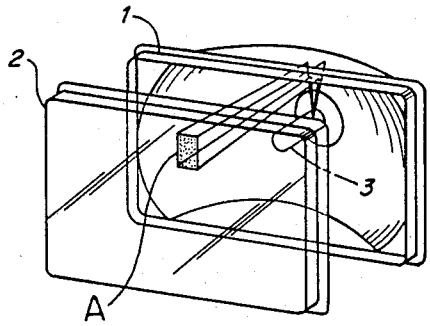
Fig. 2 (PRIOR ART)
FIG. 2 is a perspective view for explaining a concentration state of the light reflected to the lens of the conventional headlamp.
Figure 3:
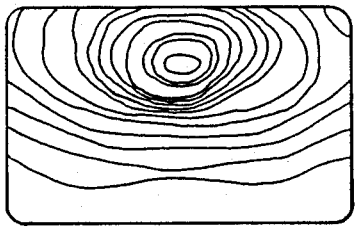
Fig. 3 (PRIOR ART)
FIG. 3 is a graph showing the heat distribution on the lens surface, due to the conventional reflector in the conventional headlamp of FIGS. 1 and 2.

As shown in FIG. 8, in the headlamp of the present invention thus constructed, if the light source 13 used for a passing or high beam light is energized, the reflected light a to be concentrated is scattered or spread over the wide region A' by the multi or composite reflecting surface 14. Therefore, the surface of the lens 12 is illuminated over a predetermined wider region than in the prior art, and the heat distribution on the surface of the lens 12 is obtained as shown in FIG. 9. As is apparent from FIG. 9, the heat is well scattered or spread over the surface of the lens 12. Therefore, a high concentration of the reflected light is not produced on the surface of the lens 12. In tests, the maximum temperature on the surface of lens 12 was actually measured to be about 115° C. Thus, with the present invention the temperature on the lens surface can be reduced by more than 25° C. in comparison with that of the conventional type headlamp described with respect to FIGS. 1–3.

Figure 10:
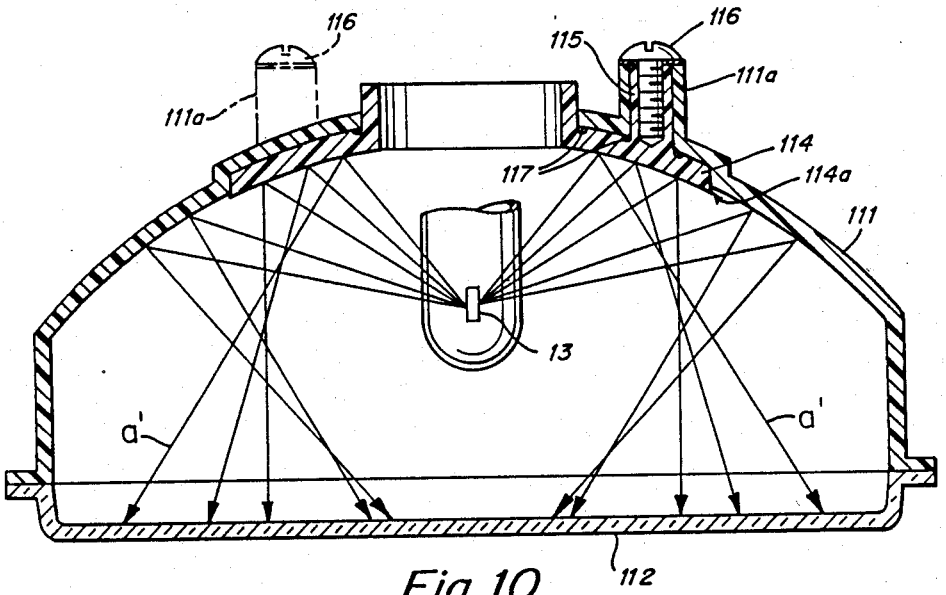
FIG. 10 is an enlarged sectional view similar to FIG. 6, showing a modified embodiment of the present invention.

Referring to FIGS. 10, 12, 13 and 14 showing a modified embodiment of the invention, the multi or composite reflecting surface 114 has a projection 115 extending therefrom. Projection 115 fits into a boss portion 111*a* on the main parabolic reflector 111 as shown in FIG. 10, and the projection 115 inserted in the boss portion is screwed to the boss portion by means of screws 116. In this manner, the multi or composite reflector 114 and the reflector 111 are integrally assembled and fixed together from the outside by using screws 116 or the like. Screws 116 may be self tapping screws. In this case, there is provided a seal member 117 at plural portions between the multi or composite reflecting surface 114 and the reflector 111 for maintaining watertightness.

Figure 11:
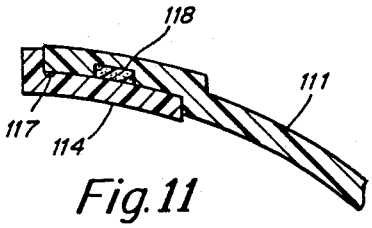
FIG. 11 is a fragmentary enlarged view showing a portion of the reflector of FIG. 10 in the area of the attachment of composite reflector 114 to reflector 111 but with a modification.

As shown in FIG. 11, it is possible not to use the boss portions 111*a* and projections 115 as mounting and connecting members. Instead, an adhesive 118 may be provided as a mounting and connecting member between the main parabolic reflector 111 and the multi or composite reflecting surface 114 for fixing both integrally together. In this case also, it is preferred to provide the seal member 117 therebetween for maintaining watertightness. The same synthetic resin material may be used for the reflector 111 and the multi or composite reflecting surface 114 in the disclosed embodiments, or different synthetic resin materials may be used for each. In the case of using different resin materials, it is possible for the multi or composite reflecting surface 114 to use a resin material having more antiheat performance than that for the reflector 111. As seen in FIGS. 10, 11, 14 and 16, an offset or step 114*a* is formed at the boundary portion between the single parabolic surface comprising a large part of the surface of the reflector 111 and the composite reflecting surface 114; but, as stated above with reference to FIG. 7, the offset 114*a* may be zero. The revolutional paraboloid comprising the composite reflecting surface 114 is defined as the surface formed in the curve of circle or ellipse when a great many of vertical parabolas are viewed in the lateral direction.

Figure 14:
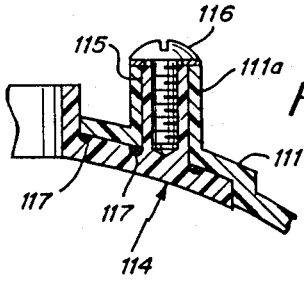
FIG. 14 is a fragmentary enlarged view showing a portion of the reflector of FIG. 10 where composite reflector 114 attaches to reflector 111.
Figure 15:
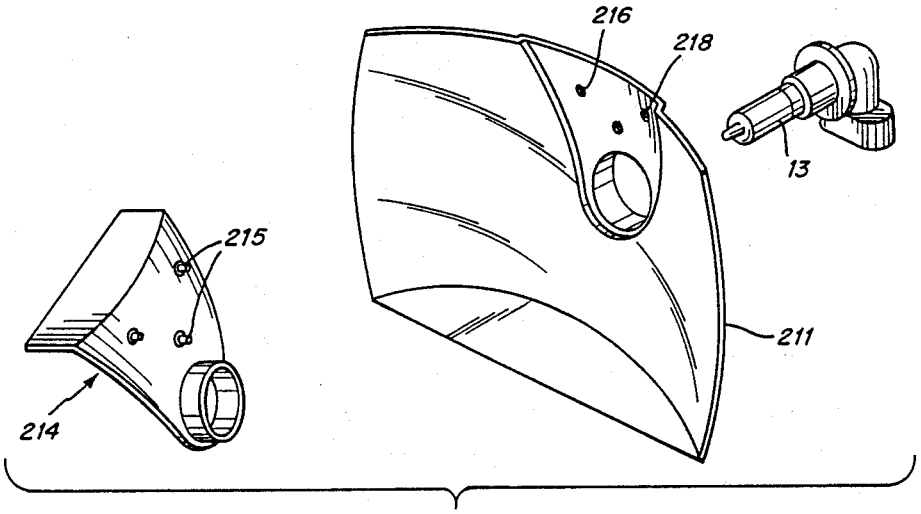
FIG. 15 is an exploded view of the reflecting surface 214, reflector 211 and bulb 213.
Figure 16:
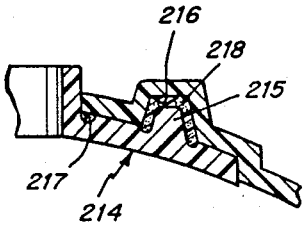
FIG. 16 is a modification of the FIG. 11 embodiment.

FIGS. 15 and 16 show a further embodiment of the present invention. Reflector 214 is provided with projections 215 accommodated within recesses 216 in reflector 211. Adhesive 218 causes reflector pins 215 to adhere to reflector 211. A seal member 217 is provided where shown. The two other seal members 117 shown in FIG. 14 are not required in this embodiment because the sealing function at those locations is performed by adhesive 218.

In the headlamp of the present invention constructed in accordance with the disclosed embodiments, if the light source 13 used for a passing or high beam light is energized, the reflected light a' to be concentrated is scattered or spread as shown by the region A' in FIG. 8 by the multi or composite reflecting surface 14. Therefore, the surface of the lens 12 is illuminated over a predetermined wide region (as shown in FIG. 8), and the heat distribution on the surface of the lens 12 is obtained as shown in FIG. 9. As is apparent from FIG. 9, the heat is well scattered or spread on the surface of the lens 12. Therefore, concentration of the reflected light is not produced on the surface of the lens 12, so that the maximum temperature on the lens surface was actually measured at about 115° C. Thus, the temperature on the lens surface can be reduced by more than 25° C. in comparison with that of the conventional type of headlamp described above with respect to FIGS. 1–3. As seen from the above, FIGS. 8 and 9 are applicable to the disclosed embodiments of the invention.

The headlamps of the present invention have an excellent advantage in that the high concentration of heat on the lens surface is substantially eliminated, thereby reducing the temperature on the lens surface. Therefore, the lens and the reflector may be made of a synthetic resin having a good molding performance and light weight, since it need not withstand so much heat.

Furthermore, since the reflector and the lens may be made of a synthetic resin, both may very easily adhere together by heat, and the resulting headlamps have not only a good anti-vibration performance but also a good overall design. Still further, in the disclosed embodiments wherein the reflector is formed independently of the multi or composite reflecting surface and then they are integrally assembled, there is an excellent advantage that not only the assembling is easy, but also the multi or composite reflecting surface may be modified in accordance with (i.e., to match) a lamp to be used, thereby increasing the flexibility of use.

We claim:

1. A headlamp for vehicles having a parabolic reflector arranged to reflect light from a light source to form a region of highly concentrated light on a lens, at which region a high temperature consequently exists, comprising:

a source of light;

a lens made of a synthetic resin;

a main parabolic reflector arranged to reflect light from said light source through said lens;

a composite reflector coupled to said main parabolic reflector and including means for reflecting and concentrating light from said light source toward said region of the lens to spread the concentrated light so as to expand the area of the region of highly concentrated light to a predetermined wider region and thereby reduce its temperature.

2. The headlamp of claim 1, wherein said composite reflector is integrally formed as one piece with said main parabolic reflector.

3. The headlamp of claim 1, wherein said composite reflector is separately formed from said main parabolic reflector, and comprising means for fixedly connecting said separate composite reflector to said main parabolic reflector.

4. The headlamp of claim 1, wherein the composite reflector is at the upper and central portion of said main parabolic reflector.

5. The headlamp claim 4, wherein said composite reflector is integrally formed as one piece with said main parabolic reflector.

6. The headlamp of claim 1, wherein the composite reflector is at the upper and central portion of said main parabolic reflector.

7. The headlamp of claim 1, wherein said connecting means comprises a plurality of projections on a side of said composite reflector facing away from said light source, means on the main parabolic reflector for receiving said projections, and means for fixing said projections to said receiving means.

8. The headlamp of claim 7, wherein said fixing means is a screw cooperating with a tapped hole in said projections.

9. The headlamp of claim 7, wherein said fixing means is an adhesive.

10. The headlamp of claim 1, further comprising sealing means to provide a water tight seal between the main parabolic reflector and the composite reflector.

11. The headlamp of claim 1, wherein said connecting means is an adhesive.

12. The headlamp of claim 1, wherein said main parabolic reflector is made of a synthetic resin.

13. The headlamp of claim 12, wherein the main parabolic reflector and the composite reflector are heat sealed to each other.

* * * * *

UNITED STATES PATENT AND TRADEMARK OFFICE

CERTIFICATE OF CORRECTION

PATENT NO. : 4,825,344

DATED : April 25, 1989

INVENTOR(S) : ICHIHARA et al

It is certified that error appears in the above-identified patent and that said Letters Patent is hereby corrected as shown below:

Column 2, line 4 "III - III" should be -- 6 - 6 -- line 10, "lamp;" should be deleted line 30, -- perspective 213 -- should be inserted after the word "exploded"

Signed and Sealed this

Eighth Day of May, 1990

*Attest:*

HARRY F. MANBECK, JR.

*Attesting Officer*

*Commissioner of Patents and Trademarks*